US005842964A

United States Patent [19]

Huber et al.

[11] Patent Number: 5,842,964

[45] Date of Patent: Dec. 1, 1998

[54] SHEET FOLDING APPARATUS WITH VACUUM GRIP

[75] Inventors: Manfred Huber, Palatine; John A. Cogswell, Arlington Heights, both of Ill.

[73] Assignee: Fred Huber & Associates, Palatine, Ill.

[21] Appl. No.: 886,480

[22] Filed: Jul. 1, 1997

[51] Int. Cl.[6] ..... B65H 45/22

[52] U.S. Cl. ..... 493/434; 493/417; 493/418; 493/424; 493/436

[58] Field of Search ..... 493/395, 396, 493/397, 398, 399, 400, 401, 402, 403, 405, 415, 416, 417, 418, 422, 424, 432, 433, 434, 435, 436, 442, 450, 454

[56] References Cited

U.S. PATENT DOCUMENTS

| | | | |
|---|---|---|---|
| 843,781 | 2/1907 | Wheeler . | |
| 2,235,484 | 3/1941 | Jesus . | |
| 2,493,410 | 1/1950 | Cour | 493/442 |
| 2,686,052 | 8/1954 | Winkler . | |
| 2,846,215 | 8/1958 | Supligeau . | |
| 3,096,977 | 7/1963 | Winkler . | |
| 3,578,311 | 5/1971 | Wood . | |
| 3,689,061 | 9/1972 | Nystrand . | |
| 3,706,450 | 12/1972 | Gerstenberger . | |
| 3,797,820 | 3/1974 | McDermott . | |
| 4,014,535 | 3/1977 | Kleid . | |
| 4,487,598 | 12/1984 | McDonald . | |
| 4,521,209 | 6/1985 | DuFresne | 493/432 |
| 4,840,609 | 6/1989 | Jones | 493/28 |
| 4,917,664 | 4/1990 | Lacaux | 493/470 |
| 5,004,451 | 4/1991 | Prum | 493/359 |
| 5,147,273 | 9/1992 | Rottman | 493/349 |
| 5,466,212 | 11/1995 | Springer | 493/434 |
| 5,624,366 | 4/1997 | Beeri | 493/23 |
| 5,716,312 | 2/1998 | Kristel | 493/245 |

*Primary Examiner*—John Sipos
*Assistant Examiner*—Christopher W. Day
*Attorney, Agent, or Firm*—Douglas B. White

[57] ABSTRACT

A sequentially timed vacuum grip system holds a sheet and transports it through a folding nip defined by a pair of folding cylinders. At the nip, the folded edge of the sheet is released and simultaneously picked-up by the paired companion cylinder. Additional folds are achieved in the same manner by the use of additional cylinder pairs.

3 Claims, 3 Drawing Sheets

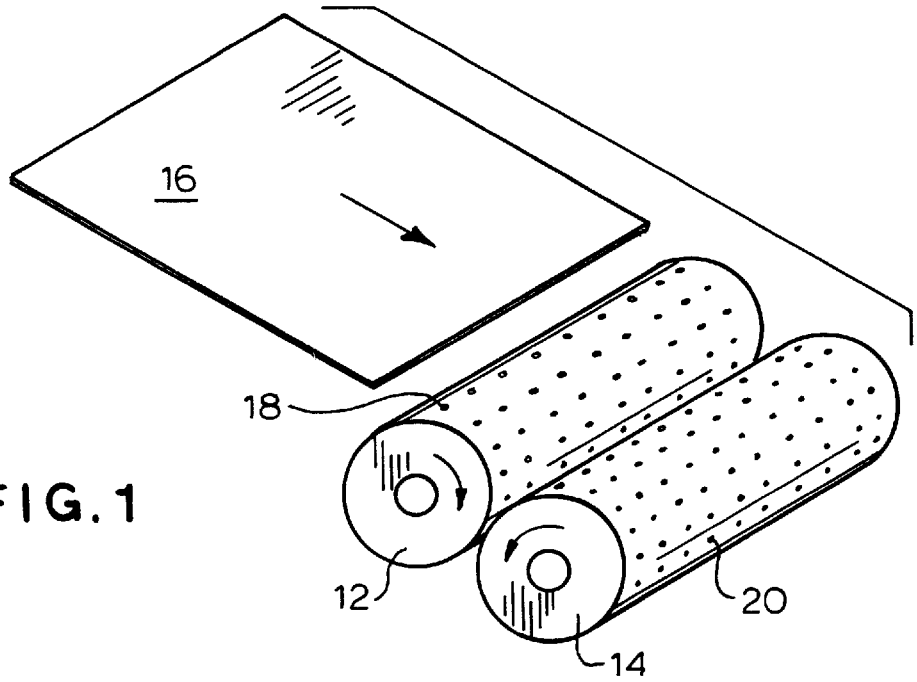
FIG. 1
FIG. 2A
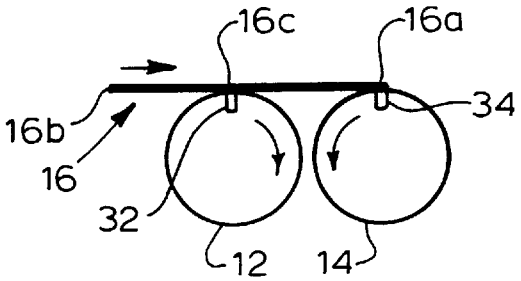
FIG. 2B
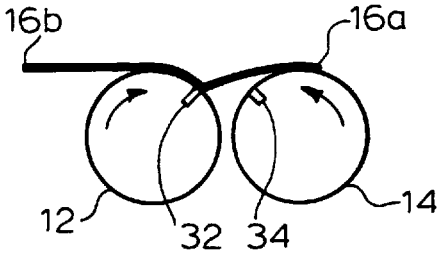
FIG. 2C
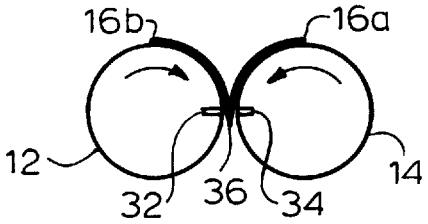
FIG. 2D
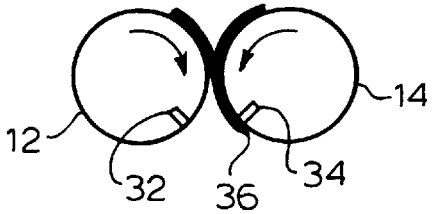

SHEET FOLDING APPARATUS WITH VACUUM GRIP

BACKGROUND OF THE INVENTION

1. Field of the Invention

This invention relates generally to apparatus for folding paper sheets. More particularly, this invention relates to a versatile apparatus and method capable of providing a wide variety of folds, including multiple folds.

2. Description of the Prior Art

Prior sheet folding devices typically feed a paper sheet onto cylinders which grip the paper using needles or folding jaws. Under high speed operation, however, inaccuracies in the location of the fold, as well as wrinkles and distortions have a tendency to occur. Prior efforts to control these effects, including the use of various devices to hold the sheets to the cylinders, have achieved only limited success.

In one attempt to control the sheet throughout the fold (U.S. Pat. No. 4,036,487) a folding jaw is employed with a folding blade in conjunction with releasable grippers, such as needles, to hold the leading and trailing edges of a sheet while a folding jaw grips and then draws the sheet off the cylinders. While this system eliminates some inaccuracies, it lacks speed and versatility due to its use of the mechanical folding jaw.

SUMMARY OF THE INVENTION

The objective of the present invention is to improve the speed and versatility of a folder while maintaining accuracy. The present invention achieves this objective and provides a high speed folder with a versatile configuration capable of achieving a variety of folds and capable of operating in-line or off-line. This is accomplished by the use of paired folding cylinders having precisely timed, sequentially controlled vacuum gripping and pressure release.

The vacuum grip system holds a sheet at one or more locations while transporting it into a folding nip defined between a pair of folding cylinders. At the nip, the folded edge of the sheet is released and simultaneously picked-up by the paired companion cylinder. Additional folds are achieved in the same manner by the use of additional cylinder pairs. Finally, either horizontal or vertical release is available by selective control of the vacuum grips and pressure release.

BRIEF DESCRIPTION OF THE DRAWINGS

FIG. 1 is a perspective view illustrating a pair of folding cylinders having vacuum grips in accordance with the present invention.

FIGS. 2A–2D is a sequential illustration depicting a pair of folding cylinders having controlled vacuum grips, showing progressive steps in a folding operation.

Figure 3A:
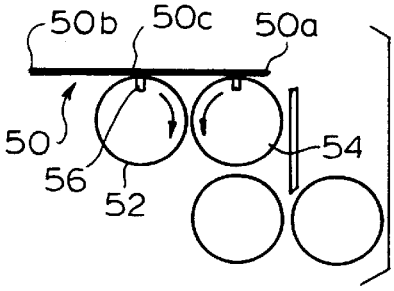
FIGS. 3A–3K is a sequential illustration depicting multiple pairs of folding cylinders having controlled vacuum grips, showing progressive steps in a multiple fold operation.
Figure 3B:
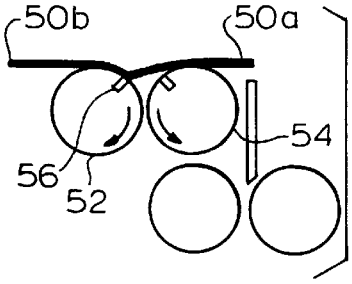
Figure 3C:
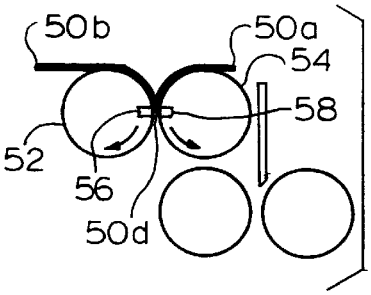

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning first to FIG. 1 there is shown a sheet folding apparatus and method employing a precision controlled vacuum grip in accordance with the present invention. Particularly, a pair of counter rotating cylinders 12 and 14 are positioned with parallel axes proximate a feed of a paper sheet 16 to receive and fold same. Sequentially controlled vacuum grips 18 and 20 are provided on the respective cylinders to selectively grip the paper sheet throughout the transport and folding operation.

The vacuum grip means generally comprises a plurality of lines of orifices distributed across the surface of each cylinder transverse to the direction of travel of the sheet. A vacuum is delivered axially to each of the cylinders and directed internally to selected orifices, in accordance with means well known to the art. While only one location (line) of vacuum orifices is illustrated in FIGS. 2A–2D, 3A–3K, and 4A–4C of the drawings and described herein, multiple lines of orifices can be activated in the same fashion to control any part, or all, of the sheet during its folding and transport.

A basic fold operation is depicted in FIGS. 2A–2D which utilizes the pair of cylinders of FIG. 1. The sheet 16, having a leading edge 16*a*, a trailing edge 16*b*, and a previously cross-scored mid portion 16*c*, is fed from a web to first and second cylinders, 12 and 14 respectively. A selected line 32 of vacuum grip orifices on the first cylinder is provided with a vacuum induced suction precisely when the sheet reaches the position shown in FIG. 1A, with a selected location in the mid portion of the sheet aligned with the vacuum grip. This timed vacuum grip holds the sheet and pulls it (FIG. 2B) into the nip between the cylinders (FIG. 2C), causing a fold to occur. Simultaneously with the entry of the fold into the nip, the vacuum grip 32 on the first cylinder 12 is deactivated to release the sheet and the vacuum grip 34 on the second cylinder 14 is activated. This synchronization of the release from the first cylinder and the grip by the second cylinder thereby transfers the folded edge 36 of the sheet to the second cylinder (FIG. 2D).

Figure 3D:
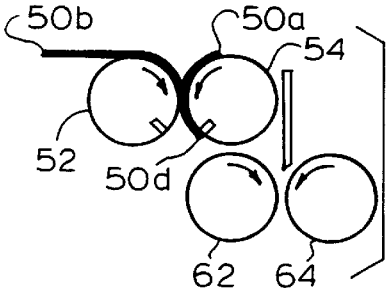
Figure 3E:
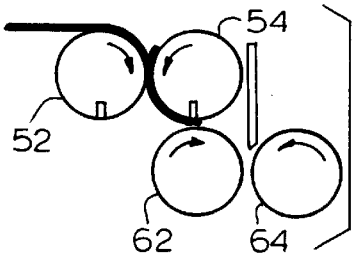
Figure 3F:
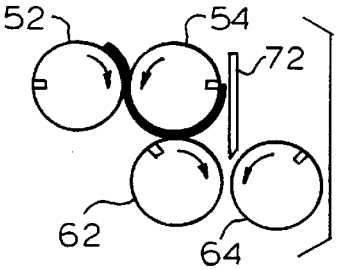

FIGS. 3A–3K depict a tri-fold achieved by use of two successive sets of paired cylinders. (Additional folds are achieved by utilizing additional paired cylinders in the same manner.) The beginning first fold is similar to the basic fold of FIGS. 2A–2D. Particularly, a sheet 50 (having leading and trailing edges 50*a* and 50*b*, and having a cross-scored mid portion 50*c*) is fed toward first 52 and second 54 upper paired cylinders. When the pre-selected mid portion location of the sheet 50*c* reaches the vacuum grip 56 of the first upper cylinder, the grip is activated (FIG. 3A), to draw the sheet toward the nip (FIG. 3B) and to begin the fold. As the fold reaches the nip (FIG. 3C) the vacuum grip of the first upper cylinder is released and the vacuum grip 58 of the second upper cylinder 54 is simultaneously activated in synchronization with the release, thereby transferring the first folded edge 50*d* of the sheet to the second upper cylinder (FIG. 3D).

Figure 3G:
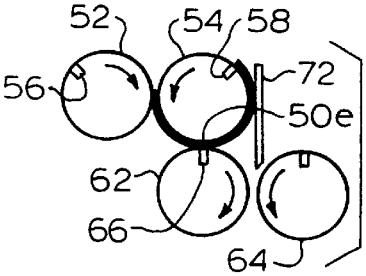
Figure 3H:
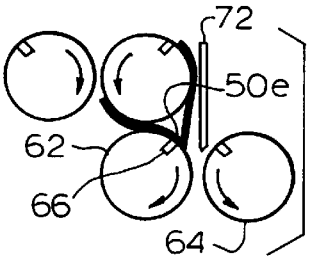
Figure 3I:
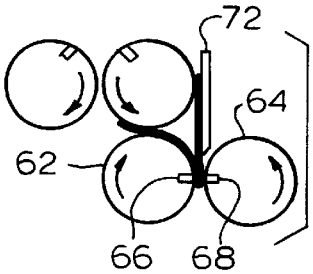
Figure 3J:
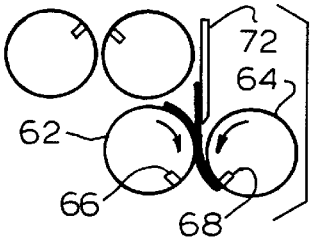
Figure 3K:
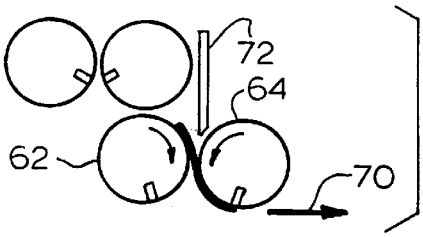

The second upper cylinder now carries the sheet (FIG. 3E) to the lower paired cylinders (62 and 64) for a similar operation. The first folded edge 50*d* is carried by the second upper cylinder 54 past the nip with the first lower cylinder 62 (FIG. 3F) until a selected second mid portion location 50*e* of the sheet aligns with the vacuum grip 66 of the first lower cylinder 62 (FIG. 3G). Precision activation of this vacuum grip seizes this second mid portion location 50*e* of the once folded sheet (FIG. 3G) and draws it (FIG. 3H) toward the nip between the lower cylinders, to create the second fold (FIG. 3I). A coincident release of the first folded edge (FIG. 3H) allows the sheet to slide off the second upper cylinder 54 during the second fold, while a guide 72 positioned proximate the second upper cylinder maintains control of the sheet. At the nip between the paired lower cylinders (FIG. 3I) the vacuum grip 66 of the first lower cylinder is released and the grip 68 of the second lower cylinder is activated in synchronization with the release of the vacuum grip 66 to discharge the folded sheet into a horizontal orientation 70. Alternatively, a vertical discharge is available by omission of the final transfer to the second lower cylinder.

Figure 4A:
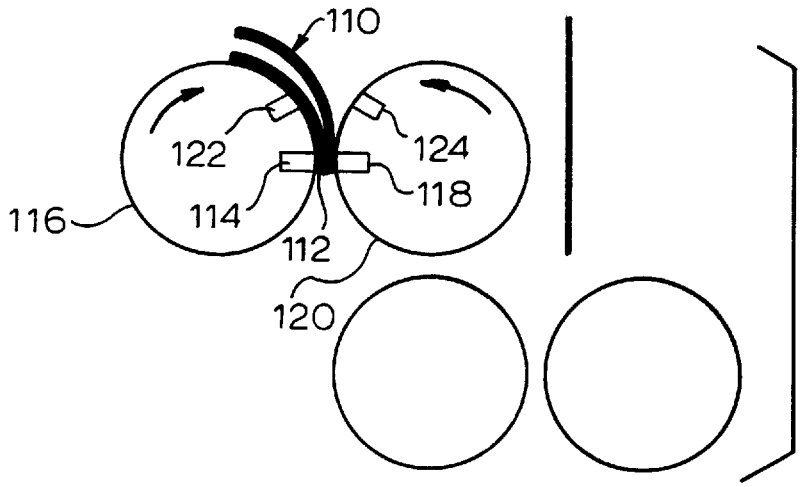
FIGS. 4A–4C is a sequential illustration similar to FIGS. 3A–3K but depicting the additional pressurized release feature.
Figure 4B:
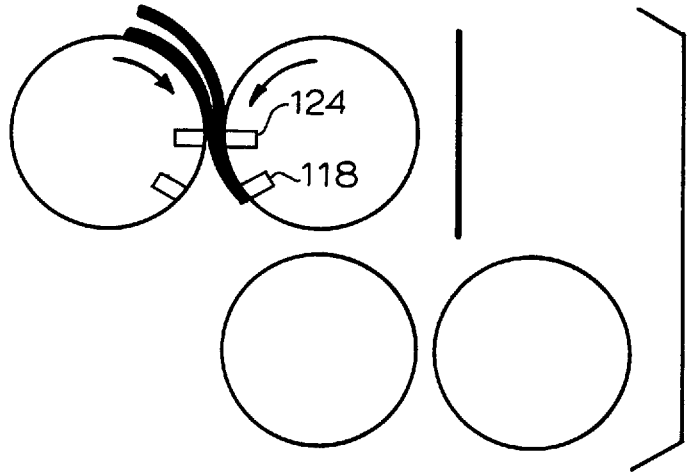
Figure 4C:
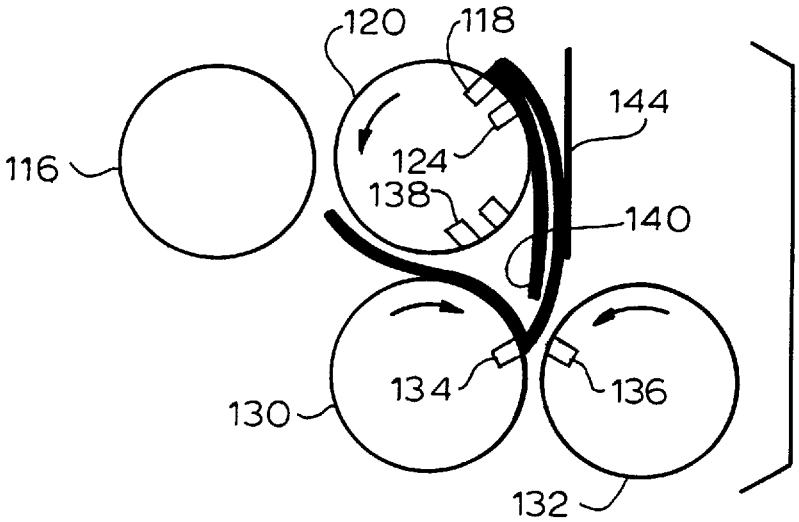

In a further feature, the vacuum grips are selectively provided with either a vacuum or a pressure, to yield either a holding grip or a releasing push. Turning to FIGS. 4A–4C there is shown an abbreviated sequence of the fold of FIGS. 3A–3K, utilizing the vacuum grip with pressure release. Particularly, a sheet 110 is fed to the folding cylinders, as before, where a defined cross-scored center portion 112 is gripped by a line of vacuum orifices 114 on the first folding cylinder 116 (FIG. 4A). Once the folded edge of the sheet reaches the nip, a vacuum is applied to the line of orifices 118 of the second cylinder 120. To further assist the transfer of the sheet to the second cylinder, pressure is simultaneously provided to the orifices 114 of the first cylinder to provide a pressure release.

Additional control of the sheet is obtained by means of the use of additional grips 122 and 124. By employing the additional vacuum grip 122 on the first cylinder during transport of the sheet into the nip between the cylinders, when the first vacuum grip 114 is released, the second grip 122 continues to carry the sheet with the first cylinder until released (FIG. 4B). Upon arrival of the vacuum grip 122 at the nip, a vacuum is provided to the second grip 124 on the second cylinder and a pressure release is simultaneously provided to the second grip 122 on the first cylinder, completing the transfer of the sheet to the second cylinder.

In the double fold process, the second cylinder 120 continues to carry the sheet while a second cross-scored mid portion of the sheet is gripped and brought into a second nip for the second fold. As in the previously described embodiment, a pair of lower cylinders 130 and 132 are positioned to grip the sheet and carry it into the second nip for the second fold. Particularly, a vacuum grip 134 on the first lower cylinder 130 grips the second mid portion of the sheet and carries it to the second nip where it can be transferred to the second lower cylinder 132. This transfer is accomplished by applying a vacuum to the grip 136 on the second lower cylinder 132 and simultaneously applying a pressure to the grip 134 on the first lower cylinder 130. (Alternatively, the sheet can be carried through the nip by the first lower cylinder and released vertically by terminating the vacuum and applying a pressure.)

In yet another feature (shown in FIG. 4C), as the sheet is brought into the second nip for the second fold, one or more grip orifices 138 on the second upper cylinder 120 are pressurized to provide control of the loose extremity 140 of the folded sheet. This provides a jet of air against the sheet intermediate the first and second mid portions while the sheet is being released from the second upper cylinder 120 and guided by the baffle plate 144.

From the foregoing description, it will be apparent that modifications can be made to the apparatus and method for using same without departing from the teachings of the present invention. Particularly, while the reference orientation of the plurality of paired cylinders has been to upper and lower, the paired cylinders and the direction of the folding operation may be reversed, from lower to upper, or even horizontally disposed. Accordingly, the scope of the invention is only to be limited as necessitated by the accompanying claims.

What is claimed is:

1. Apparatus for producing a tri-fold in a paper sheet comprising:

a first cylinder and a second cylinder, each rotating relative to each other about parallel axes and defining a first nip therebetween;

first synchronized vacuum means defined on said first cylinder for gripping the sheet in a selected first mid portion location thereof, drawing the sheet thereby into said first nip, and for releasing said selected first mid portion location upon arrival in said first nip;

second synchronized vacuum means defined on said second cylinder for gripping the sheet with said second cylinder when the sheet arrives at said first nip, in synchronization with said release by said first synchronized vacuum means, for drawing the sheet thereby past said first nip, and for selectively releasing said selected first mid portion location;

a third cylinder and a fourth cylinder, each rotating relative to each other and relative to said first and second cylinders about parallel axes, defining a second nip between said third and fourth cylinders and defining a third nip between said second and third cylinders; and third synchronized vacuum means defined on said third cylinder for gripping the sheet in a selected second mid portion location thereof in synchronization with said release of said second synchronized vacuum means, drawing the sheet into said second nip, and for releasing said selected second mid portion location upon arrival in said second nip.

2. The apparatus for producing a tri-fold in a paper sheet of claim 1 further comprising fourth synchronized vacuum means for gripping the sheet with said fourth cylinder when the sheet arrives at said second nip, in synchronization with said release by said third synchronized vacuum means, for drawing the sheet thereby past said second nip, and for selectively releasing said selected second mid portion location.

3. A process for producing a tri-fold in a paper sheet comprising:

(a) moving the sheet along a path tangential to paired first and second counter rotating cylinders positioned on parallel axes to form a first nip therebetween;

(b) actuating a first synchronized vacuum grip on said first cylinder when a first selected mid portion location of the sheet is superimposed thereon and thereby gripping the sheet at said selected mid-portion location;

(c) drawing said first selected mid portion of the sheet into said first nip between said first and second cylinders to form a first fold and to define a first folded edge;

(d) releasing said first synchronized vacuum grip on said first cylinder to thereby release said first selected mid-portion of the sheet;

(e) actuating a second synchronized vacuum grip on said second cylinder when the sheet arrives in said first nip in synchronization with said release of step d to thereby grip the sheet;

(f) moving said first folded edge of the sheet along a path defined by the surface of said second cylinder, past a third nip formed between said second cylinder and a third cylinder, said third cylinder counter rotating relative to said second cylinder on an axis parallel to said axis of said second cylinder;

(g) actuating a third synchronized vacuum grip on said third cylinder when a second selected location in the mid portion of the folded sheet is superimposed thereon to thereby grip said second selected location of the sheet;

(h) releasing said second synchronized vacuum grip in synchronization with said actuation of said third synchronized vacuum group of step g to thereby transfer the sheet to said third cylinder;

(i) drawing the sheet into a second nip formed between said third cylinder and a fourth cylinder, said fourth cylinder counter rotating relative to said third cylinder on an axis parallel to said third cylinder to form a second fold; and (j) releasing said third synchronized vacuum grip.

* * * * *